United States Patent [19]

Bonasera

[11] Patent Number: 4,765,608

[45] Date of Patent: Aug. 23, 1988

[54] FINGER EXERCISER

[76] Inventor: Joseph C. Bonasera, 150 Highland Dr., Kings Park, N.Y. 11754

[21] Appl. No.: 77,664

[22] Filed: Jul. 24, 1987

[51] Int. Cl.[4] ..... A63B 23/00

[52] U.S. Cl. ..... 272/67; 84/465

[58] Field of Search ..... 272/67, 68; 128/26, 128/75, 77, 87 A; 84/465, 467, 468

[56] References Cited

U.S. PATENT DOCUMENTS

| | | | |
|---|---|---|---|
| 248,980 | 11/1881 | Atkins | 128/26 |
| 494,197 | 3/1893 | Hall | 84/467 |
| 818,332 | 4/1906 | Anson | 272/67 |
| 867,981 | 10/1907 | Krizek | 272/67 |
| 3,724,314 | 4/1973 | Columbo | 84/465 |

FOREIGN PATENT DOCUMENTS

| | | | |
|---|---|---|---|
| 1438402 | 2/1967 | France | 128/26 |

*Primary Examiner*—Richard J. Apley
*Assistant Examiner*—J. Welsh
*Attorney, Agent, or Firm*—Richard L. Miller

[57] ABSTRACT

This device is designed to fit on the wrist and fingers of a musician, so as to develop the hand and fingers for better speed and coordination. Primarily, it consists of a fork secured to the wrist of the user, and tines of the fork are provided with sleeves having resilient components attached for applying tension to the fingers. The device further includes hook and loop fastener straps for securing the components to the fingers of the musician, and the main body of the fork is received in a wrist band attached to the musician's wrist.

3 Claims, 1 Drawing Sheet

FINGER EXERCISER

BACKGROUND OF THE INVENTION

The instant invention relates generally to physical development devices, and more particularly, to a finger exerciser.

Numerous finger and hand exercisers have been provided in the prior art that are adapted to develop muscles and the like. For example, U.S. Pat. Nos. 3,360,261 of Smolensky, 3,612,521 of Wendeborn, and 4,227,342 of Knowles all are illustrative of such prior art. While these units may be suitable for the particular purpose to which they address, they would not be as suitable for the purpose of the present invention as hereafter described.

SUMMARY OF THE INVENTION

A primary object of the present invention is to provide a finger exerciser that will overcome the shortcomings of the prior art devices.

Another object is to provide a finger exerciser, which will be of such design, as to enable a musician to develop his hand and finger speed coordination and strength.

An additional object is to provide a finger exerciser, which will be of such structure, as to enable the musician to perform repetitive scales, such as arpeggios and riffs while the fingers and hand are under some resistance, for faster response.

A further object is to provide a finger exerciser that is simple and easy to use.

A still further object is to provide a finger exerciser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
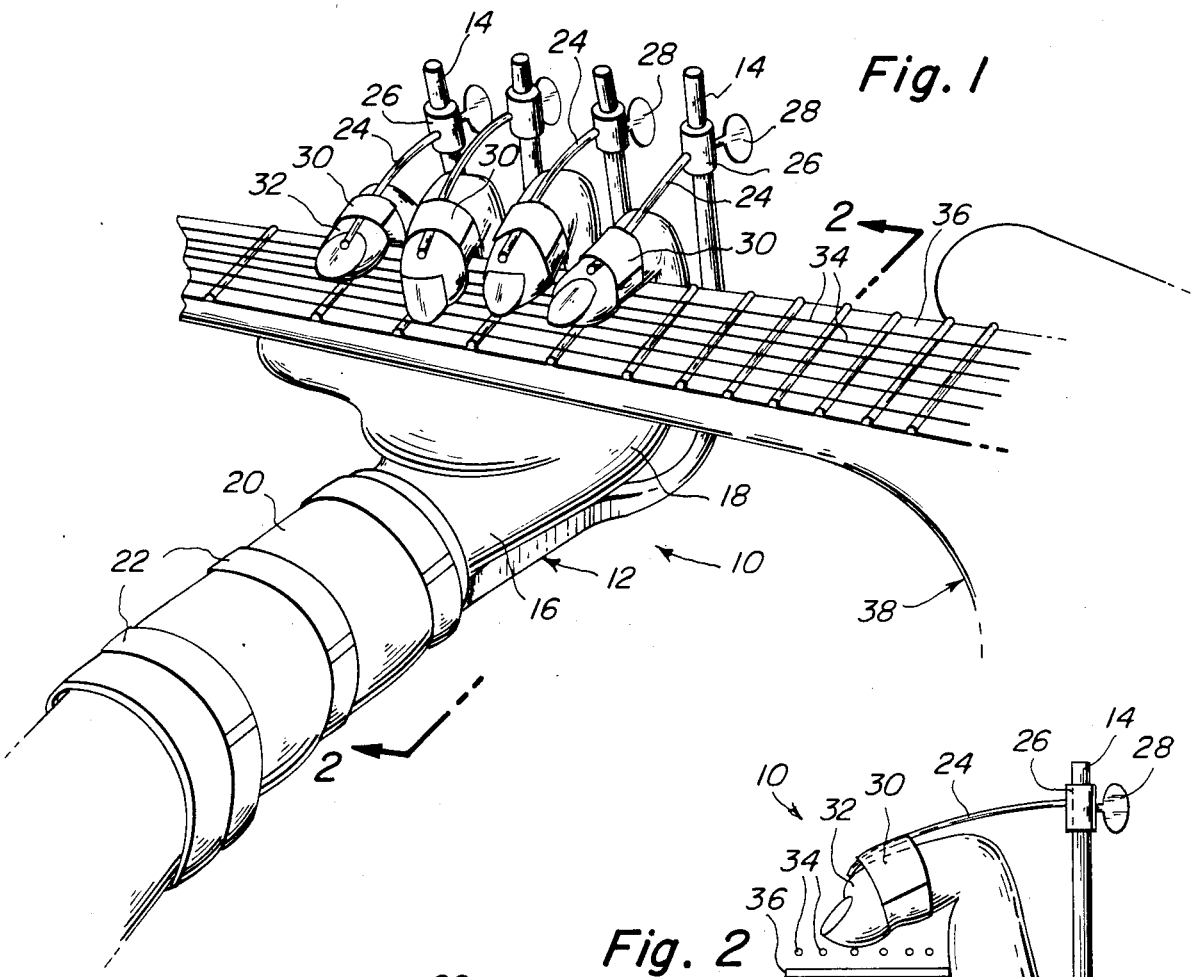
FIG. 1 is a perspective view of the invention mounted on a player's wrist and fingers, and shown in operative position on a typical string instrument.
Figure 2:
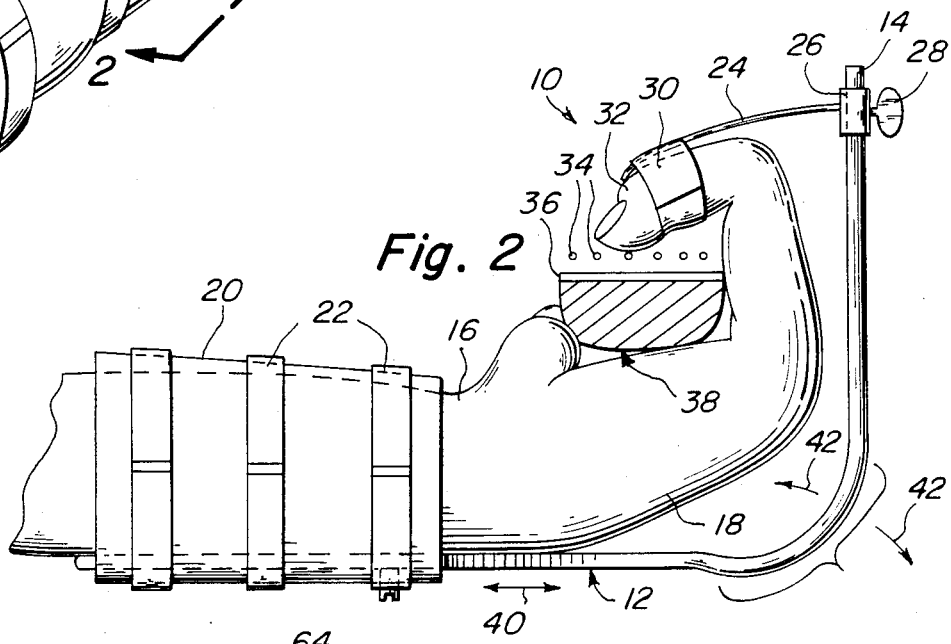
FIG. 2 is a side view thereof, illustrating some of the adjustable features and showing especially an adjustable area indicated by the bracket and arrows.

Turning now descriptively to the drawings, in which like reference characters denote like elements throughout the several views, a device 10 is shown to include a light weight metal fork 12 having four tines 14 integrally attached thereto. A main body of fork 12 is secured to the wrist 16 of a user's hand 18, by a leather wrist band 20 fastened by mating hook and loop pile fasteners 22.

Four resilient component 24 are provided and each component 24 is fixedly secured at one end in a sleeve 26 that is secured adjustably in elevation on a tine 14 of the fork 12, by a thumb screw 28 threadingly received in sleeve 26. The other end of component 24 is fixedly secured to a mating hook and loop fastener strap 30 that is adjustably secured to a finger 32 of the user's hand 18, and the components 24 provide for tension resistance when the user is fingering the strings 34 of the fret board 36 of a guitar 38. The component 24 may be fabricated out of various material such as rubber, spring steel, plastic etc. depending upon the user's individual needs.

It shall be noted, that fork 12 may be adjustably moved forward or rearward as indicated by the arrow 40, and the tines 14 also have resiliency in bending, as indicated by the arrows 42.

In use, as the user fingers the strings 34 of guitar 38, the fingers 32 of the musician cause tension to be placed on the component 24, thereby developing the user's fingers 32 for enabling faster response and coordination when he is playing without the device 10, and adjustability is effected by elevating or lowering the sleeves 26, through the use of thumb screws 28. Further adjustments is effected by thrusting fork 12 inward or outward of band 20.

Figure 3:
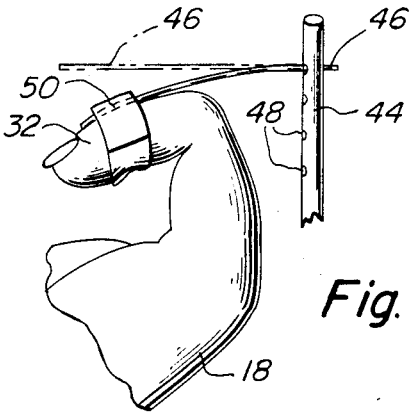
FIG. 3 is a fragmentary view similar to FIG. 2, illustrating a modified construction thereof.

Looking now at FIG. 3, a modified form of tine 44 includes a resilient component 46 that is suitably secured in any of one of a plurality of spaced openings 48 through tine 44, and the other end of component 46 is secured in a mating hook and loop fastener 50 received on a finger 32 of a musician's hand 18.

In operation, tine 44 and its attached component 46 function in the same manner as described of tine 14 and its component 24.

Figure 4:
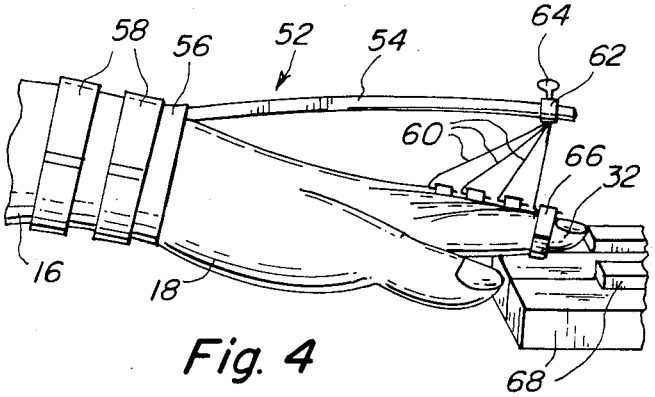
FIG. 4 is perspective view of another embodiment of the invention mounted on a player's wrist and fingers, and shown in operative position on a typical key board instrument.

Referring now to FIG. 4 of the drawing, another modified form of device 52 is shown to include a rod 54 received in a wrist band 56 that held is to wrist 16 by hook and loop fasteners 58, and components 60 are fixedly secured to a sleeve 62 received on rod 54. A thumb screw 64 is received in sleeve 62 and provides for rendering sleeve 62 secure in any desired position on the rod 54. The other ends of components 60 are secured to hook and loop fastener straps 66 that are received on the fingers 32 of the hand 18, and modified device 52 is employed in playing piano Keys 68.

In use, modified device 52 provides tension for the musician's fingers 32, through the components 60 and the rod 54, which is similar to that described of device 10, the only exception being, that components 60 are fastened to a rod 54, instead of tines 14 of a fork 12.

It shall also be recognized that the present invention may be modified to be employed for typing, hand and finger as concerned with arthritis, drawing, etc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A finger exerciser device comprising:

a fork, for securement to a wrist of a user, provided with a main body and a plurality of tines integrally attached at one end of said main body;

a plurality of sleeves adjustably received on said fork such that each sleeve slideably engages a respective tine, and each sleeve including a tension component fixedly secured thereto for applying force to a finger of a user;

fastening means secured to each said component for fastening said component to a finger of a user; and locking means on each sleeve for securing said sleeve in any desired position along the length of said respective tine.

2. A finger exerciser device as set forth in claim 1, wherein each said component is fixedly secured to said fastening means that comprises a mating hook and loop pile fastener strap adapted to be received on a finger of said user, and said main body of said fork extends longitudinally along a wrist of said user and is secured thereto by an engagement means.

3. A finger exerciser device as set forth in claim 1, wherein said main body is slidably attached to said engagement means, which is a wrist band received on said wrist, and said wrist band is adapted to be fastened to said wrist of said user by other mating hook and loop pile fasteners material located on the outer periphery of said wrist band.

* * * * *